US005868463A

United States Patent [19]

MacKenzie et al.

[11] Patent Number: 5,868,463

[45] Date of Patent: Feb. 9, 1999

[54] SEAT CUSHION WITH SELECTIVELY INFLATABLE INTERIOR SEAT AND BACK COMPARTMENTS

[75] Inventors: Kirk L. MacKenzie, Charlotte, N.C.; Bengt Engstrom, Hasselby, Sweden

[73] Assignee: Novus Designs, Inc., Charlotte, N.C.

[21] Appl. No.: 943,796

[22] Filed: Oct. 3, 1997

[51] Int. Cl.[6] ..... A47C 31/00

[52] U.S. Cl. ..... 297/228.12; 297/255; 297/452.23; 297/452.33; 297/452.41

[58] Field of Search ..... 297/219.1, DIG. 3, 297/452.41, 452.48, 250.1, 254, 255, 452.61, 230.1, 230.13, 228.12, 284.6, 452.23, 452.33, 452.34; 5/655.3, 654

[56] References Cited

U.S. PATENT DOCUMENTS

| | | |
|---|---|---|
| D. 106,986 | 11/1937 | Manson . |
| D. 182,647 | 4/1958 | Cox . |
| 2,343,996 | 3/1944 | Perry . |
| 3,017,642 | 1/1962 | Rosenberg et al. . |
| 3,112,956 | 12/1963 | Schick et al. . |
| 3,253,861 | 5/1966 | Howard . |
| 3,276,047 | 10/1966 | Emery . |
| 3,421,163 | 1/1969 | Stoughton . |
| 3,533,113 | 10/1970 | Stamberger . |
| 3,540,776 | 11/1970 | Wilson . |
| 4,054,960 | 10/1977 | Pettit et al. . |
| 4,207,633 | 6/1980 | Smith et al. . |
| 4,459,714 | 7/1984 | Lin . |
| 4,836,605 | 6/1989 | Greenwood et al. . |
| 4,905,332 | 3/1990 | Wang . |
| 5,190,350 | 3/1993 | Hwang et al. . |
| 5,314,235 | 5/1994 | Johnson . |
| 5,335,382 | 8/1994 | Huang . |
| 5,335,968 | 8/1994 | Sheridan et al. . |
| 5,469,592 | 11/1995 | Johnson . |

*Primary Examiner*—Milton Nelson, Jr.
*Attorney, Agent, or Firm*—Kennedy Covington Lobdell & Hickman LLP

[57] ABSTRACT

An seat cushion is adapted to selectively conform to a user's anatomy with a seat portion having at least one inflatable interior seat compartment with a resiliently compressible foam element disposed therein. The compartment also has an openable and closable seat valve for selectively communicating the seat compartment with the ambient atmosphere. The foam is expanded and compressed within the seat compartment in relation to selective application of a compression force acting on the seat portion when the seat valve is opened to selectively draw inflating air into and exhaust inflating air from the seat compartment.

14 Claims, 4 Drawing Sheets

SEAT CUSHION WITH SELECTIVELY INFLATABLE INTERIOR SEAT AND BACK COMPARTMENTS

BACKGROUND OF THE INVENTION

The present invention relates to a seat cushion, and more particularly to a seat cushion that is selectively conformable to a user's anatomy by deflating and inflating the seat cushion in combination with selective compression and expansion of resiliently compressible foam.

There are a variety of articles that are currently used as seat cushions having some means of inflation of the seat cushion. These cushions are typically constructed of two sheets of material overlapped and sealed, into which air is introduced either by physically blowing the air into the cushion by mouth or by a pump. Once such cushions are inflated they are used to cushion the anatomy of a user when placed between the user and a seating surface. Such cushions have a drawback in that they are often unable to conform to the user's anatomy to provide adequate support, leading to pinching, the falling asleep of extremities, and other discomforts. This also leads to improper posture. These cushions also do not provide stability to the user.

There are also a variety of seat cushions utilizing some sort of foam that also cushions the user's anatomy when the foam is placed between the user and the object on which the user is to sit. One drawback to this type of cushion is that when a user shifts position slightly the foam shifts with the user and does not provide continuous support of the user's anatomy. Further, such cushions may also provide pressure points, as discussed above, resulting in cramping, pinching, and other discomforts, and leading to poor posture.

SUMMARY OF THE INVENTION

It is an object of the present invention to provide a seat cushion that may be selectively contoured to make a user more comfortable due to reduced pressure against the legs and pelvis and to make the trunk of the user more stable, decreasing muscle tension in the trunk. It is also an object of the present invention to provide a cushion that may be selectively conformed to a user's anatomy in order to provide support for posture and to decrease fatigue when sitting for an extended period of time. It is further an object of the present invention to provide a precontoured area under and behind the pelvis resulting in a thinner overall cushion that provides appropriate support. Another object of the present invention is optimization of the pressure distribution and stability and improvement of the posture of the trunk of the user when utilizing the cushion of the present invention.

The present invention provides a seat cushion adapted to selectively conform to a user's anatomy. The seat cushion has a seat portion and a back portion which are conjoined for relative pivotal movement along a pivot axis. The seat portion and the back portion define respective concavities on opposite sides of the pivot axis, the concavities collectively forming a pelvic opening between the seat portion and the back portion to receive a user's pelvic area once the user is seated on the seat cushion.

Each of the seat portion and the back portion has an inflatable interior seat compartment, a resiliently compressible foam element disposed within the compartment, and an openable and closable valve for selectively communicating the compartment with the ambient atmosphere.

The foam element in each of the seat compartment and the back compartment is able to be expanded and compressed therewithin in relation to selective application of a compression force acting on the seat or back portion when the seat or back valve is open to selectively draw inflating air into and exhaust inflating air from the seat or back compartment.

DESCRIPTION OF THE PREFERRED EMBODIMENT

Figure 1:
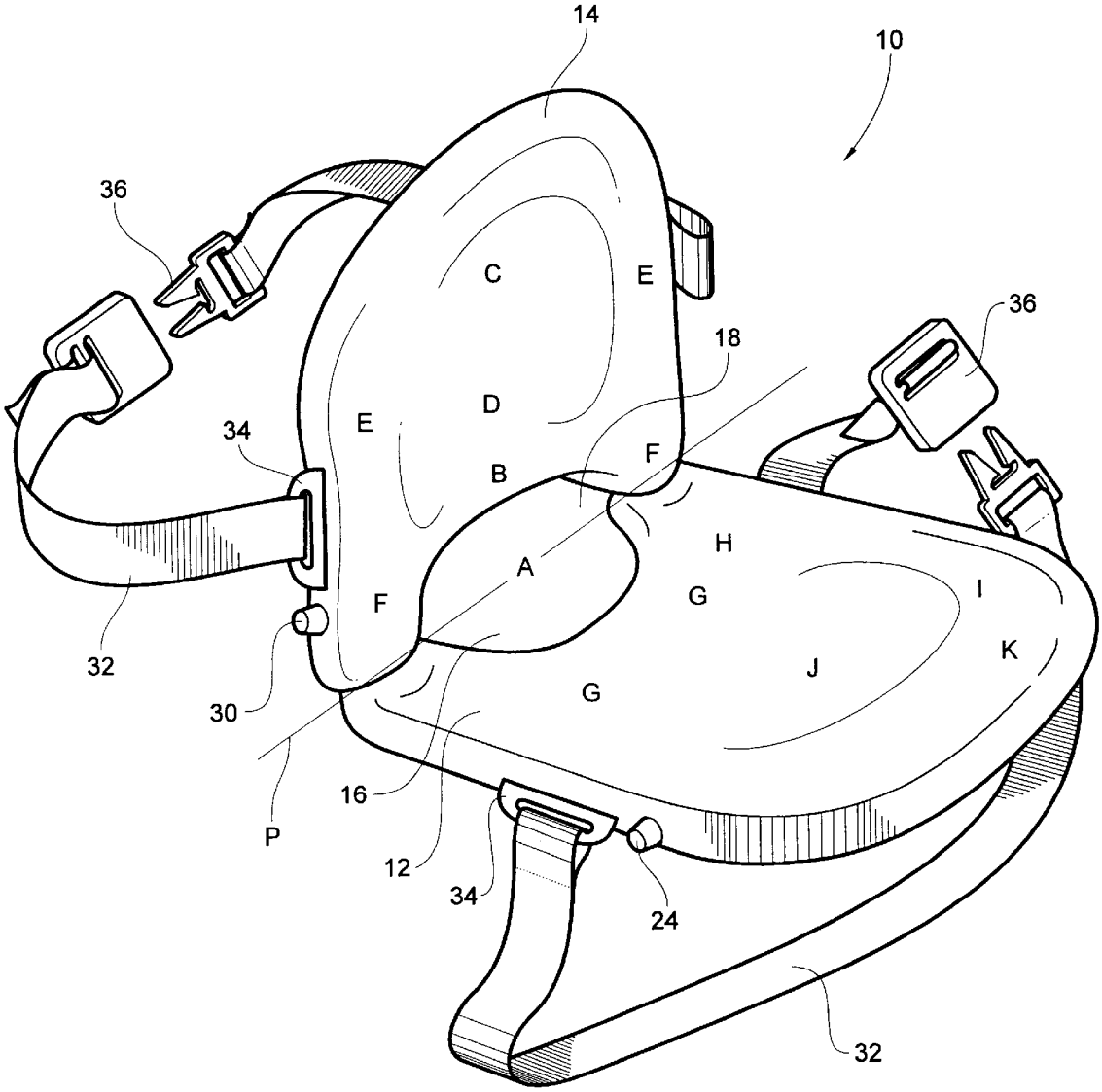
FIG. 1 is a perspective view of the seat cushion of the present invention.

The seat cushion 10 has a seat portion 12 and a back portion 14, as illustrated in FIG. 1. The seat portion 12 is joined to the back portion 14 at points along a pivot axis P therebetween such that the seat portion 12 and the back portion 14 may be pivoted relative to each other into an angular seating disposition shown in FIG. 1. The seat portion 12 and the back portion 14 define respective concavities 16, 18 on opposite sides of the pivot axis to collectively form a pelvic opening A between the seat portion 12 and the back portion 14 to receive a user's pelvic area when sitting on the seat cushion 10.

Figure 2:
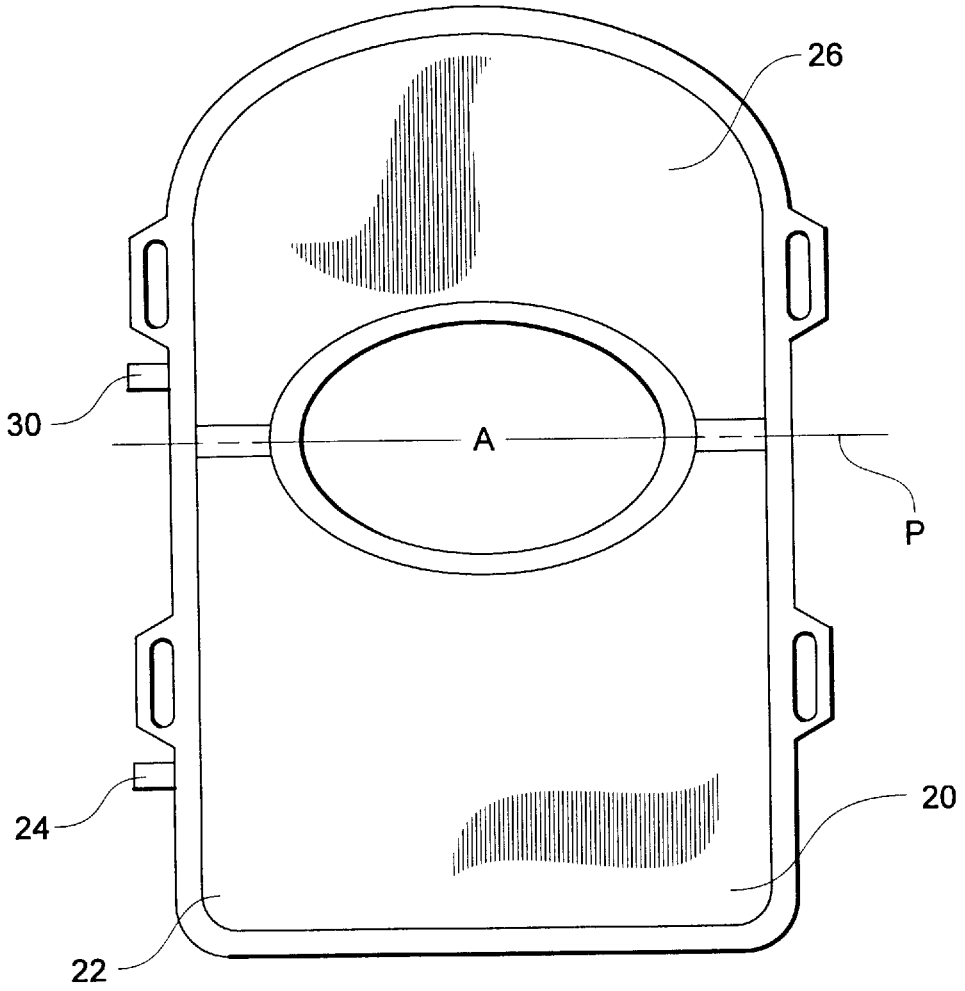
FIG. 2 is a plan view of the seat cushion in FIG. 1, without straps attached.
Figure 3:
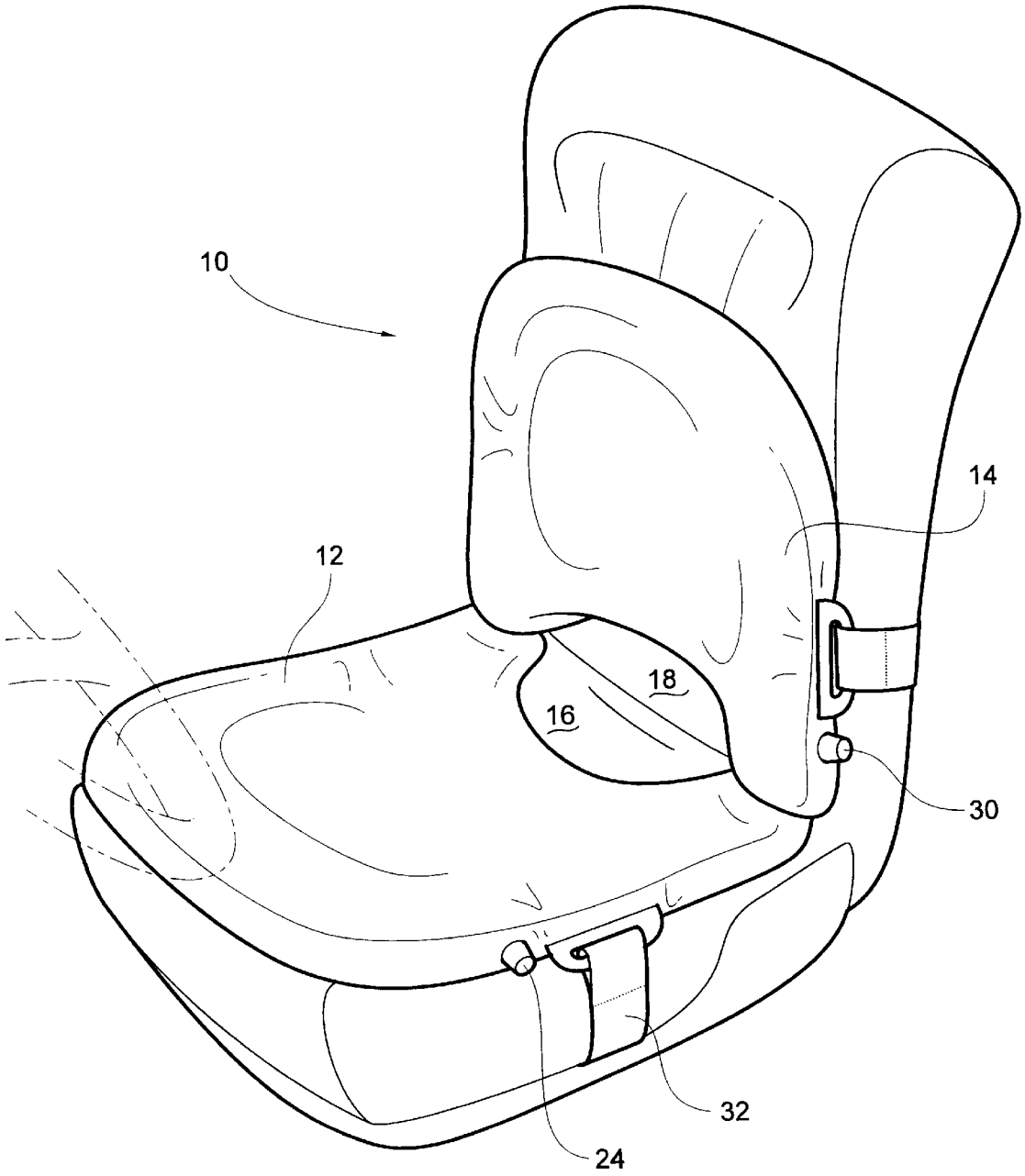
FIG. 3 is a perspective view of the seat cushion of FIG. 1 in place upon a seat.

The seat portion 12 has an inflatable interior seat compartment 20, as illustrated in FIG. 2, with a resiliently compressible seat foam element 22 disposed therein. The seat compartment 20 also has an openable and closable seat valve 24 for selectively communicating the seat compartment 20 with the ambient atmosphere.

The seat portion 12 is constructed using an airtight fabric that is glued or otherwise adhered to the seat foam element 22. The airtight fabric ensures that air cannot enter the seat compartment 20, except through the seat valve 24.

The back portion 14 has an inflatable interior back compartment 26, as illustrated in FIG. 2, with a resiliently compressible back foam element 28 disposed therein. The back compartment 26 also has an openable and closable back valve 30 for selectively communicating the back compartment 26 with the ambient atmosphere.

The back portion 14 is also constructed using an airtight fabric that is glued or otherwise adhered to the back foam element 28. The airtight fabric ensures that air cannot enter the back compartment 26 except through the back valve 30.

The seat portion 12 and the back portion 14 connect on both sides of the concavities 16, 18, and, thus, not under the pelvis. This makes the area under and behind the pelvis an empty oval area which precontours the cushion to make it concave where it is needed—under and behind the pelvis. Because of this empty area, the cushion can be made thinner in other areas than if this area also had foam.

The resiliently compressible foam element disposed within the seat compartment 20 and back compartment 26 may be of any such foam known in the art. This foam is sized such that it could expand to a larger volume than the compartment in which it is placed, so that when the valves 24, 30 are opened and no compressive force is placed upon the foam elements 22, 28, air will be drawn into the interior of the compartment 20, 26. By gently opening one or both valves 24, 30 while a user is seated, the air will escape and the foam elements 22, 28 will become compressed more where the pressure is the greatest. This means that the compartments 20, 26 will become thinner where a concavity is needed, such as under the ischial bones, behind the upper part of the pelvis, and for the thoracic spine. Since the fabric is glued or otherwise adhered to the foam, surfaces of the seat portion 12 and back portion 14 will remain flat and not have "bubbles" of air trapped within. It is preferable that the foam elements 22, 28 entirely fill the compartments 20, 26. When the valves 24, 30 are shut with a user seated on the cushion 10, the foam elements 22, 28 will be "locked" in place because it is not possible for air to escape to allow the foam elements 22, 28 to spring back to their previous positions. Thus, the foam elements 22, 28 will retain the contour imparted to them by the specific compression force configuration of the individual user. In this way, the cushions can be formed specifically to contour to the user's body and provide support in those areas where support is needed for comfort or for posture.

The area designated as A on FIG. 1 is an empty area that creates a stable position of the pelvis between the seat portion 12 and the back portion 14. It also reduces the pressure against the pelvis that would normally be associated with a typical seat cushion that does not have such an opening for the pelvis.

The area indicated as area B provides support against the upper parts of the pelvis that makes the pelvis more stable in an upright position. This support prevents the pelvis from tilting backward and makes it easier to balance the trunk, and also prevents the pelvis from sliding forward on the seat. A stable pelvis in a functional position prevents the spine from excessive flexing when trunk extending muscles relax. This decreases the pressure against the tail bone. The amount of support provided by the area indicated as B is selectively adjustable through contouring of the back and providing pressure against this area while the back valve 30 is opened.

The area of FIG. 1 indicated as area C is to support the thoracic spine of the user. This upper part of the back of the back portion 14 is made thinner by deflating the back portion 14 by opening back valve 30 while leaning back and exerting pressure against area C. In this way area C may be contoured to a person's desired level of thoracic support.

Deflation of areas B (pelvic support) and C (thoracic extension) makes the area indicated on FIG. 1 as area D thicker than areas B and C. This optimizes the contour needed against the lower back. Area D creates a personal lumbar support. Since the areas B, C, and D are easily adjusted at any time, the user always has several trunk position options available.

The deflation of area C (thoracic extension) makes that area thinner and makes the area indicated on FIG. 1 as area E thicker than area C. This creates a support area on either side of the thorax which improves trunk stability when the person is leaning against the back portion 14.

The thinning of area B (pelvic support) behind the pelvis makes the area indicated as area F on FIG. 1 thicker than area B. This creates a support area on either side of the pelvis which improves the stability of the pelvis. A laterally stable pelvis also makes the trunk more stable laterally, which is very beneficial when the user is reaching to either side. An efficient contour provides support for the upper and lower area of the pelvis. These support areas may be selectively adjusted depending upon each individual user.

The areas indicated as areas G on FIG. 1 provides support of the ischial bones to prevent the pelvis from sliding forward. This is an efficient way to prevent the spine from excessive flexing when the trunk extending muscles relax. The degree of support/stability of the ischial bones is adjustable through the selective contouring of the seat. The amount of support provided by areas G not only changes the support against the ischial bones, but also changes the pressure against the ischial bones, which has a direct effect upon the perceived comfort of the cushion by the user. If the areas G are thick, the support is great and the pressure against the ischial bones decreases. If the areas G are thin, support is less than the pressure increases. Together, areas B and G efficiently decrease the pressure against both the tail bone and the ischial bones.

The area indicated on FIG. 1 as area H provides a lateral support for the hips and pelvis. This prevents lateral sliding in the seat and, thus, also provides lateral support for the trunk.

Area I as indicated on FIG. 1 provides support for the legs. The legs are comfortably supported sideways when the seat portion 12 is slightly deflated. When the legs are stable in a slightly abducted position, they will assist the pelvis to more efficiently maintain an upright position. Typically, a seated individual will often stabilize the trunk by pressing the feet against the floor or pressing the thighs against the seat. Therefore, in long term seating situations, the pressure against the thighs can be a major stress factor. The ability of the present cushion to support the legs and the thighs decreases and distributes the pressure more evenly and contributes to reduced stress and improved comfort.

When the legs are supported against the seat, as in area I, the section between the legs, as indicated by area J on FIG. 1, is a little thicker than the areas under the legs. This makes the legs supported from the inside, as well as from the outside. If more contour is desired, the seat is selectively deflated.

The area indicated as area K on FIG. 1 is important because it presses against the lower part of the thigh where blood circulation is easily strangled by excessive and long term pressure. Like the rest of the cushion 10, area K is compressible and flexible. The pressure against the legs is continuously changing when the person is moving on the seat portion 12. The front part of the seat portion 12 is especially flexible to prevent blocking of the blood circulation to and from the lower legs. Selectively adjusting the contour in areas I, J, and K also will prevent the legs from falling asleep during extended periods of seating.

The shape and support provided by the seat cushion 10 may be selectively adjusted by selectively placing an uneven compression force upon a surface of the seat compartment 20 and/or the back compartment 26. While this compressive force is placed, the seat valve 24 and/or back valve 30 is opened to release air from within the compartment 20, 26 to enable the resiliently compressible foam elements 22, 28 to selectively compress relative to the uneven compression force exerted thereon. When the desired amount of contour is attained, the valve 24, 30 is closed to stop the exit of air from within the compartment 20, 26, causing the resiliently compressible foam element 22, 28 to stop being compressed and to be essentially "locked" into place. The foam element 22, 28 is prevented from springing back to its original position because the compartment 20, 26 is constructed of an airtight material such that air is prevented from entering the compartment 20, 26. Without the incoming air, the foam element 22, 28 is unable to expand, and the contour is "fixed."

When the pressure against the body normally associated with seating is low and well distributed over a large surface of support, the sitting comfort and long term tolerance is improved. The contouring of the seat cushion 10 of the present invention makes the person more comfortable due to lower pressure against the legs and the pelvis, and it simultaneously makes the seat much more stable in which to sit. This seat stability also makes the trunk, pelvis, and legs more stable, which decreases muscle tension of the trunk.

The contouring of the back portion 14 makes it easier to achieve a comfortably stable trunk position and the result is the relaxation of trunk extending muscles. The contouring and recontouring of the seat cushion 10 allow a person to continuously change the support provided by the seat portion 12 and the back portion 14. This significantly improves tolerance for extended sitting periods for many people in many different sitting situations. As will be obvious, this can significantly improve comfort levels for those who are occupationally required to engage in extended periods of time seated, such as truck drivers, office workers, etc.

Figure 4:
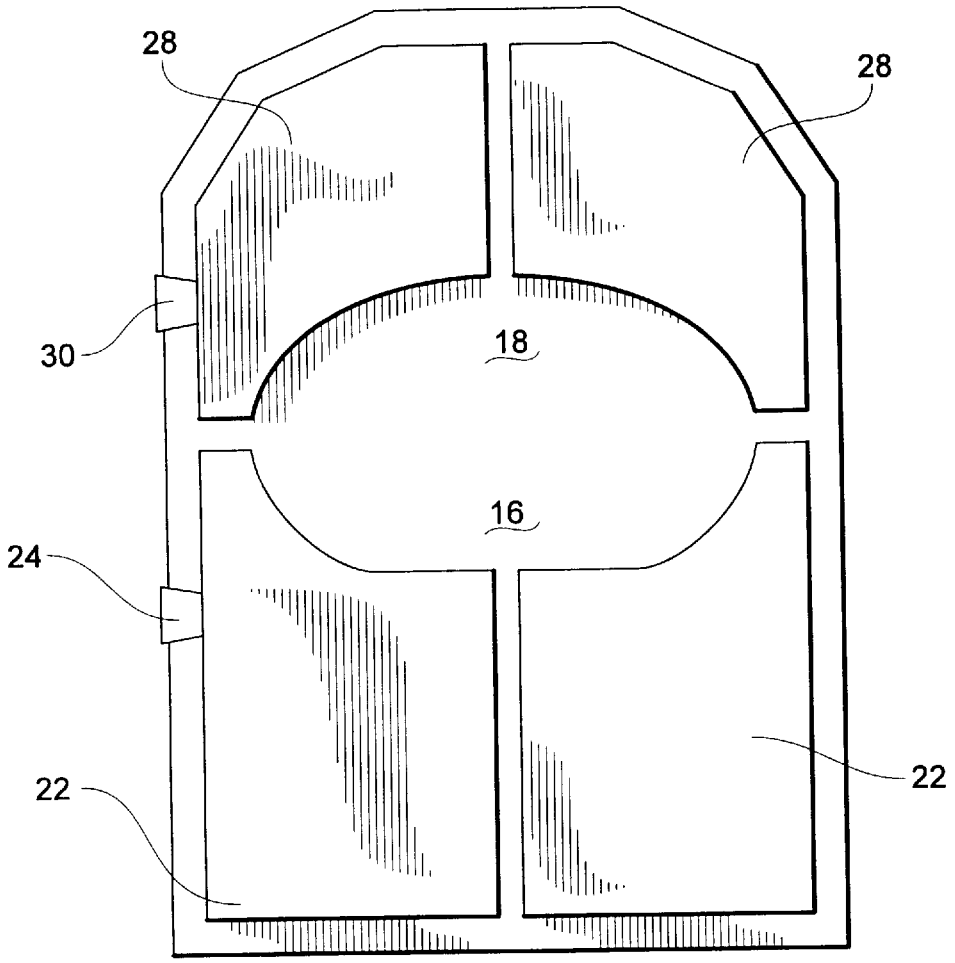
FIG. 4 is a plan view of another embodiment of the seat cushion of FIG. 1 in which there are four compartments.

In an alternate embodiment, the inflatable interior compartment 20, 26 may be divided into more than one compartment, each having a foam element 22, 28 as illustrated in FIG. 4. The selection of the placement of different compartments and foam elements 22, 28 may be made based upon accommodation of existing materials, ease of storage, accommodation of specific needs and other factors.

While the seat cushion 10 of the present invention may be merely placed upon the seating surface, it may also be desirable to secure the seat cushion 10 to the seating surface. To effect securing the cushion 10 to a seat, the seat portion 12 and the back portion 14 may be provided with straps 32 attached to the seat cushion 10 via attachment slots 34. Straps 32 may also be provided with buckle assemblies 36 for securing the straps 32 and the seat cushion 10 to the seating surface. It should be recognized that other methods of attachment, buckling, etc. may be utilized without departing from the spirit of the invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A seat cushion adapted to selectively conform to a user's anatomy comprising:

(a) a seat portion to underlie a user's buttocks when sitting on the seat cushion, the seat portion having at least one inflatable interior seat compartment, a resiliently compressible foam element disposed within the seat compartment and an openable and closable seat valve for selectively communicating the seat compartment with the ambient atmosphere, the foam element being expanded and compressed within the seat compartment in relation to selective application of a compression force acting on the seat portion when the seat valve is opened to selectively draw inflating air into, and exhaust inflating air from, the seat compartment;

(b) a back portion to rest against a user's back when sitting on the seat cushion, the back portion having at least one inflatable interior back compartment, a resiliently compressible foam element disposed within the back compartment, and an openable and closable back valve for selectively communicating the back compartment with the ambient atmosphere, the foam element being expanded and compressed within the back compartment in relation to selective application of a compression force acting on the back portion when the back valve is opened to selectively draw air into, and exhaust inflating air from, the back compartment;

(c) means conjoining the seat portion and the back portion to one another for relative pivotal movement along a pivot axis; and (d) the seat portion and the back portion defining respective concavities at opposite sides of the pivot axis, the concavities collectively forming a pelvic opening between the seat portion and the back portion to receive a user's pelvic area when sitting on the seat cushion.

2. The seat cushion of claim 1, wherein the compressible foam element within the seat compartment is adhered to the interior of the seat compartment.

3. The seat cushion of claim 1, wherein the compressible foam element within the back compartment is adhered to the interior of the back compartment.

4. The seat cushion of claim 1, wherein the seat portion comprises two inflatable seat compartments, each having a resiliently compressible foam element disposed therein, at least one seat compartment having the openable and closable seat valve, the seat compartments being in communication with each other for selectively communicating both seat compartments with the ambient atmosphere through the seat valve, and wherein the back portion comprises two inflatable back compartments, each having a resiliently compressible foam element disposed therein, at least one back compartment having the openable and closable back valve, the back compartments being in communication with each other for selectively communicating both back compartments with the ambient atmosphere through the back valve.

5. The seat cushion of claim 4, wherein each compressible foam element is adhered to the interior of the corresponding compartment.

6. The seat cushion of claim 1, further comprising means for securing the seat cushion to a seat.

7. The seat cushion of claim 6, wherein the means for securing comprises at least one strap that may be wrapped around the seat to which the seat cushion is to be secured.

8. The seat cushion of claim 7, wherein the means for securing comprises two straps, each having a first end and a second end, the first end attached to the seat cushion and the second end attached to a buckle, the two buckles removably connectable to each other, whereby the buckles may be attached to each other when the straps are placed around the seat to secure the seat cushion to the seat.

9. A seat cushion adapted to selectively conform to a user's anatomy, comprising:

(a) a seat portion to underlie a user's buttocks when sitting on the seat cushion, the seat portion having an inflatable interior seat compartment, a resiliently compressible foam element disposed within the seat compartment and an openable and closable seat valve for selectively communicating the seat compartment with the ambient atmosphere, (b) the foam being expanded and compressed within the seat compartment in relation to selective application of a compression force acting on the seat portion when the seat valve is opened to selectively draw inflating air into, and exhaust inflating air from, the seat compartment;

(c) a back portion to rest against a user's lower back when sitting on the seat cushion, the back portion having an inflatable interior back compartment, a resiliently compressible foam element disposed within the back compartment, and an openable and closable back valve for selectively communicating the back compartment with the ambient atmosphere, (d) the foam element in the back compartment being expanded and compressed therewithin in relation to selective application of a compression force acting on the back portion when the back valve is opened to selectively draw inflating air into, and exhaust inflating air from, the back compartment;

(e) means conjoining the seat portion and the back portion to one another for relative pivotal movement along a pivot axis;

(f) the seat portion and the back portion defining respective concavities at opposite sides of the pivot axis, the concavities collectively forming a pelvic opening between the seat portion and the back portion to receive a user's pelvic area when sitting on the seat cushion.

10. The seat cushion of claim 9, further comprising means for securing the seat cushion to a seat.

11. The seat cushion of claim 10, wherein the means for securing comprises at least one strap attached to the seat portion and at least one strap attached to the back portion that may be wrapped around the seat to which the seat cushion is to be secured.

12. The seat cushion of claim 11, wherein the means for securing comprises two straps attached to the seat portion and two straps attached to the back portion, each strap having a first end and a second end, the first end attached to the seat cushion and the second end attached to a buckle, the buckles removably connectable to the corresponding buckle on the corresponding strap, whereby the buckles may be attached to each other when the straps are placed around the seat to secure the seat cushion to the seat.

13. A seat cushion adapted to selectively conform to a user's anatomy, comprising:

(a) a seat portion to underlie a user's buttocks when sitting on the seat cushion, the seat portion having two inflatable interior seat compartments, a resiliently compressible foam element disposed within each seat compartment and an openable and closable seat valve for selectively communicating at least one of the seat compartments with the ambient atmosphere, the seat compartments being in communication with each other for selectively communicating both seat compartments with the ambient atmosphere through the seat valve, and the foam elements being expanded and compressed within the seat compartments in relation to selective application of a compression force acting on the seat portion when the seat valve is opened to selectively draw inflating air into, and exhaust inflating air from, the seat compartments; and (b) a back portion to rest against a user's back when sitting on the seat cushion, the back portion having two inflatable interior back compartments, a resiliently compressible foam element disposed within each back compartment, and an openable and closable back valve for selectively communicating at least one of the back compartments with the ambient atmosphere, the back compartments being in communication with each other for selectively communicating both back compartments with the ambient atmosphere through the back valve, and the foam elements being expanded and compressed within the back compartments in relation to selective application of a compression force acting on the back portion when the back valve is opened to selectively draw air into, and exhaust inflating air from, the back compartments.

14. The seat cushion of claim 13, wherein each compressible foam element is adhered to the interior of the corresponding compartment.

* * * * *